US012742282B2

(12) United States Patent
Harvey

(10) Patent No.: US 12,742,282 B2
(45) Date of Patent: Sep. 22, 2026

(54) DRYER DUCT SENSING AND CLEANING

(71) Applicant: STATE FARM MUTUAL AUTOMOBILE INSURANCE COMPANY, Bloomington, IL (US)

(72) Inventor: Brian N. Harvey, Bloomington, IL (US)

(73) Assignee: STATE FARM MUTUAL AUTOMOBILE INSURANCE COMPANY, Bloomington, IL (US)

( * ) Notice: Subject to any disclaimer, the term of this patent is extended or adjusted under 35 U.S.C. 154(b) by 694 days.

(21) Appl. No.: 18/197,243

(22) Filed: May 15, 2023

(65) Prior Publication Data

US 2024/0376662 A1 Nov. 14, 2024

Related U.S. Application Data

(60) Provisional application No. 63/465,050, filed on May 9, 2023.

(51) Int. Cl.

| | |
|---|---|
| ***D06F 58/50*** | (2020.01) |
| ***D06F 58/45*** | (2020.01) |
| ***D06F 103/30*** | (2020.01) |
| ***D06F 103/32*** | (2020.01) |
| ***D06F 103/36*** | (2020.01) |
| ***D06F 103/56*** | (2020.01) |

(52) U.S. Cl.

CPC ..... *D06F 58/50* (2020.02); *D06F 58/45* (2020.02); *D06F 2103/30* (2020.02); *D06F 2103/32* (2020.02); *D06F 2103/36* (2020.02); *D06F 2103/56* (2020.02)

(58) Field of Classification Search

CPC ..... D06F 58/50; D06F 58/45; D06F 2103/30; D06F 2103/32; D06F 2103/36; D06F 2103/56; D06F 34/26; D06F 58/20; D06F 2103/08; D06F 2105/58

See application file for complete search history.

(56) References Cited

U.S. PATENT DOCUMENTS

| | | | | |
|---|---|---|---|---|
| 4,689,896 | A * | 9/1987 | Narang | D06F 58/20 34/604 |
| 4,891,892 | A * | 1/1990 | Narang | D06F 58/20 34/86 |
| 5,860,224 | A * | 1/1999 | Larson | D06F 58/22 34/607 |
| 6,158,148 | A * | 12/2000 | Krausch | D06F 58/50 34/497 |
| 6,220,092 | B1 * | 4/2001 | Catbagan | D06F 58/20 116/274 |

(Continued)

*Primary Examiner* — David J Laux

(74) *Attorney, Agent, or Firm* — MARSHALL, GERSTEIN & BORUN LLP; William J. Samore

(57) ABSTRACT

The following relates generally to dryer duct safety. In some embodiments, a system may include an airflow sensor configured to measure airflow in a dryer duct. The system may further include one or more processors configured to receive an operation status signal of a dryer, determine an airflow level based upon an airflow signal received from the airflow sensor, and determine that a clog exists in the dryer duct based upon: (i) the airflow level and (ii) the operation status signal. The system may further include a robotic component to clean the dryer duct upon determining a clog exists.

19 Claims, 5 Drawing Sheets

(56) References Cited

U.S. PATENT DOCUMENTS

| | | | | |
|---|---|---|---|---|
| 6,971,186 | B1 * | 12/2005 | Chin | D06F 58/45 34/140 |
| 2003/0061728 | A1 * | 4/2003 | Reede | F26B 21/37 34/526 |
| 2004/0111792 | A1 * | 6/2004 | Shaltiel | F16L 55/128 4/255.01 |
| 2005/0060824 | A1 * | 3/2005 | Hillenbrand | B08B 9/0436 15/206 |
| 2006/0288605 | A1 * | 12/2006 | Carow | G06Q 30/0258 34/446 |
| 2006/0288608 | A1 * | 12/2006 | Carow | D06F 58/50 34/604 |
| 2010/0058611 | A1 * | 3/2010 | Neumann | G01M 99/005 73/168 |
| 2014/0366397 | A1 * | 12/2014 | Wakizaka | D06F 58/206 34/524 |
| 2019/0292716 | A1 * | 9/2019 | Yu | D06F 58/50 |
| 2021/0214884 | A1 * | 7/2021 | Smith | D06F 58/50 |
| 2023/0279601 | A1 * | 9/2023 | Bellinger | D06F 34/26 34/492 |

* cited by examiner

DRYER DUCT SENSING AND CLEANING

CROSS-REFERENCE TO RELATED APPLICATIONS

This application claims priority to U.S. Patent Application No. 63/465,050, entitled Dryer Duct Sensing and Cleaning, filed May 9, 2023.

FIELD

The present disclosure generally relates to systems and methods for dryer safety

BACKGROUND

Naturally, over time, as dryers are run, lint and/or other materials may build up in a dryer duct. This presents at least two problems. First, this may cause an increased risk of fire starting in the dyer duct. Second, it may reduce airflow in the dryer duct, thereby increasing the drying time.

The systems and methods disclosed herein provide solutions to these problems and may provide solutions to the ineffectiveness, insecurities, difficulties, inefficiencies, encumbrances, and/or other drawbacks of conventional techniques.

SUMMARY

The present embodiments relate to, inter alia, improving dryer safety. For example, clogs in dryer ducts (e.g., for clothes dryers, such as a residential or industrial clothes dryer, etc.) may increase the risk of fire. To reduce this risk, the systems and methods discussed herein may determine that a clog exists in a dyer duct (e.g., based upon an airflow level, an operation status signal of the dryer, a pressure level, a temperature level, a dryer duct displacement level, etc.). Upon detection of a clog, some embodiments may turn off the dryer and/or activate a robotic component to clean the dryer duct.

In one aspect, a computer system for dryer safety may be provided. The computer system may include one or more local or remote processors, sensors, transceivers, servers, memory units, augmented reality glasses or headsets, extended or virtual reality headsets, smart glasses or watches, wearables, and/or other electronic or electrical components. In one aspect, the computer system may include one or more processors configured to: (1) receive an operation status signal of the dryer; (2) determine an airflow level based upon an airflow signal received from the airflow sensor; and/or (3) determine that a clog exists in the dryer duct based upon: (i) the airflow level; and (ii) the operation status signal. The computer system may include additional, less, or alternate functionality, including that discussed elsewhere herein.

In another aspect, a computer-implemented method for dryer safety may be provided. The method may be implemented via one or more local or remote processors, sensors, transceivers, servers, memory units, augmented reality glasses or headsets, extended or virtual reality headsets, smart glasses or watches, wearables, and/or other electronic or electrical components. In one aspect, the method may include: (1) receiving, via one or more processors, an operation status signal of the dryer; (2) determining, via the one or more processors, an airflow level based upon an airflow signal received from the airflow sensor; and/or (3) determining, via the one or more processors, that a clog exists in the dryer duct based upon: (i) the airflow level; and (ii) the operation status signal. The method may include additional, fewer, or alternate actions, including those discussed elsewhere herein.

In yet another aspect, a computer device for dryer safety may be provided. The computer device may include one or more local or remote processors, sensors, transceivers, servers, memory units, augmented reality glasses or headsets, extended or virtual reality headsets, smart glasses or watches, wearables, and/or other electronic or electrical components. In one aspect, the computer device may include: one or more processors; and/or one or more memories coupled to the one or more processors. The one or more memories including computer executable instructions stored therein that, when executed by the one or more processors, may cause the one or more processors to: (1) receive an operation status signal of the dryer; (2) determine an airflow level based upon an airflow signal received from the airflow sensor; and/or (3) determine that a clog exists in the dryer duct based upon: (i) the airflow level; and (ii) the operation status signal. The computer device may include additional, less, or alternate functionality, including that discussed elsewhere herein.

BRIEF DESCRIPTION OF THE DRAWINGS

Advantages will become more apparent to those skilled in the art from the following description of the preferred embodiments which have been shown and described by way of illustration. As will be realized, the present embodiments may be capable of other and different embodiments, and their details are capable of modification in various respects. Accordingly, the drawings and description are to be regarded as illustrative in nature and not as restrictive.

The figures described below depict various aspects of the applications, methods, and systems disclosed herein. It should be understood that each figure depicts an embodiment of a particular aspect of the disclosed applications, systems and methods, and that each of the figures is intended to accord with a possible embodiment thereof. Furthermore, wherever possible, the following description refers to the reference numerals included in the following figures, in which features depicted in multiple figures are designated with consistent reference numerals.

DETAILED DESCRIPTION

The present disclosure generally relates to systems and methods for dryer safety. For instance, clogs in dryer ducts may increase the risk of fire. In addition, a clog in a dryer duct may reduce airflow in the dryer duct, thereby increasing the drying time. The systems and methods discussed herein may provide elegant solutions to these problems. For example, embodiments discussed herein, may determine that a clog exists in a dyer duct (e.g., based upon an airflow level, an operation status signal of the dryer, a pressure level, a temperature level, a dryer duct displacement level, etc.). Upon detection of a clog, some embodiments may turn off the dryer and/or activate a robot to clean the dryer duct.

Exemplary Dryer Safety System

Figure 1:
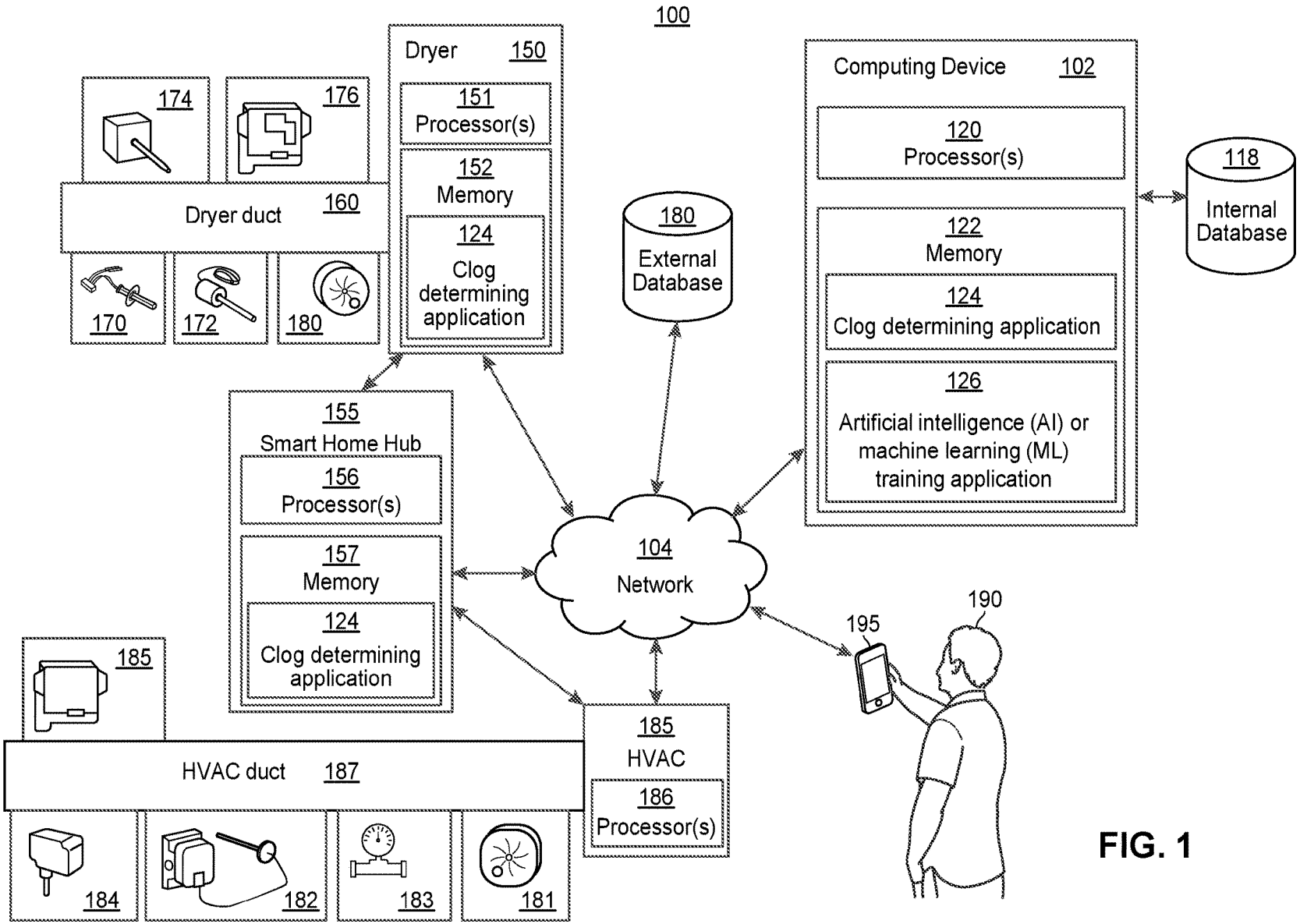
FIG. 1 illustrates an exemplary dryer duct safety system, according to an embodiment.

To this end, FIG. 1 illustrates an exemplary computer system 100 for dryer safety in which the exemplary computer-implemented methods described herein may be implemented. The high-level architecture includes both hardware and software applications, as well as various data communications channels for communicating data between the various hardware and software components.

For instance, the exemplary computer system 100 may detect clogs in the dryer duct 160. The clogs may be detected by any of the dryer 150 (e.g., a clothes dryer, such as a residential or industrial clothes dryer, etc.), the smart home hub 155, and/or the computing device 102.

The dryer 150 may include one or more processors 151 such as one or more microprocessors, controllers, and/or any other suitable type of processor. The dryer 150 may further include a memory 152 (e.g., volatile memory, non-volatile memory) accessible by the one or more processors 151, (e.g., via a memory controller). The one or more processors 151 may interact with the memory 152 to obtain and execute, for example, computer-readable instructions stored in the memory 152. Additionally or alternatively, computer-readable instructions may be stored on one or more removable media (e.g., a compact disc, a digital versatile disc, removable flash memory, etc.) that may be coupled to the dryer 150 to provide access to the computer-readable instructions stored thereon. In particular, the computer-readable instructions stored on the memory 152 may include instructions for executing various applications, such as clog determining application 124.

In operation, the clog determining application 124 (which may run on any of the dryer 150, smart home hub 155, and/or computing device 102) may determine clogs in the dryer duct 160. For example, as discussed elsewhere herein, the clog determining application 124 may determine clogs based upon signals received from any of the airflow sensor 170, pressure sensor 172, temperature sensor 174, accelerometer 176, and/or one or more processors 151 (e.g., an operation status signal, etc., from the one or more processors 151). Moreover, although the example system 100 illustrates only one of each of the airflow sensor 170, pressure sensor 172. temperature sensor 174, and accelerometer 176, any number of airflow sensors 170, pressure sensors 172, temperature sensors 174, and/or accelerometers 176 may be used.

The airflow sensor 170 may be any type of airflow sensor (e.g., a volume airflow sensor, a mass airflow sensor, etc.). In addition, the airflow sensor 170 may be positioned at any point within the dryer duct 160. In some examples, one airflow sensor 170 may be placed at the exhaust of the dryer 160 (e.g., where the dryer 150 connects to the dryer duct 160, such as a dryer attachment area), and another airflow sensor 170 may be placed at the opposite end of the dryer duct 160 (e.g., where the dryer duct 160 enters/exits the building); advantageously, such placement improves accuracy of the airflow measurement.

The pressure sensor 172 may be any type of pressure sensor, such as an aneroid barometer pressure sensor, a manometer pressure sensor, a bourdon tube pressure sensor, a vacuum (Pirani) pressure sensor, a sealed pressure sensor, a piezoelectric pressure sensor, a strain gauge pressure sensor, etc. The pressure sensors 172 may be positioned at any point inside the dryer duct 160. In some embodiments, a pressure sensor 172 is positioned at the exhaust of the dryer 160 (e.g., where the dryer 150 connects to the dryer duct 160, such as at a dryer attachment area).

The temperature sensor 174 may be any type of temperature sensor, such as a thermometer, a thermistor, a thermocouple, resistance temperature detector (RTD), a thermopile, an infrared (IR) temperature sensor, etc. The temperature sensors 174 may be positioned at any point inside and/or outside of the dryer duct 160. In some embodiments, a temperature sensor 174 is positioned at the exhaust of the dryer 160 (e.g., where the dryer 150 connects to the dryer duct 160, such as at a dryer attachment area).

The accelerometer 176 may be any type of accelerometer (e.g., an alternating current (AC)-response accelerometer, a direct current (DC)-response accelerometer, etc.). The accelerometer 176 may be positioned anywhere on the inside and/or the outside of the dryer duct 160. In some implementations, the accelerometer 176 may be used to determine a dryer duct displacement level (e.g., an amount that the dryer duct 160 has expanded, such as an increase in a diameter, length, and/or width of the dryer duct 160).

Any of the any of the airflow sensor 170, pressure sensor 172, temperature sensor 174, and/or accelerometer 176 may be connected to the dryer 150 and/or smart home hub 155 through the network 104 (e.g., the internet, etc.). Additionally or alternatively, airflow sensor 170, pressure sensor 172, temperature sensor 174, and/or accelerometer 176 may be connected to the dryer 150 and/or smart home hub 155 directly, such as via a wired (e.g., ethernet, etc.), and/or wireless (e.g., via Bluetooth, etc.).

The dryer 150 may be connected to the smart home hub 155 through the network 104 (e.g., the internet, etc.). Additionally or alternatively, the smart home hub 155 and dryer 150 may be directly connected to each other, such as via a wired (e.g., ethernet, etc.), and/or wireless (e.g., via Bluetooth, etc.).

The smart home hub 155 may include one or more processors 156 such as one or more microprocessors, controllers, and/or any other suitable type of processor. The smart home hub 155 may further include a memory 157 (e.g., volatile memory, non-volatile memory) accessible by the one or more processors 156, (e.g., via a memory controller). The one or more processors 156 may interact with the memory 157 to obtain and execute, for example, computer-readable instructions stored in the memory 157. Additionally or alternatively, computer-readable instructions may be stored on one or more removable media (e.g., a compact disc, a digital versatile disc, removable flash memory, etc.) that may be coupled to the smart home hub 155 to provide access to the computer-readable instructions stored thereon. In particular, the computer-readable instructions stored on the memory 157 may include instructions for executing various applications, such as clog determining application 124.

The smart home hub 155 may further be connected to any smart device of a home, such as via a wired (e.g., ethernet, etc.), and/or wireless (e.g., via Bluetooth, etc.).

The computing device 102 may include one or more processors 120 such as one or more microprocessors, controllers, and/or any other suitable type of processor. The computing device 102 may further include a memory 122 (e.g., volatile memory, non-volatile memory) accessible by the one or more processors 120, (e.g., via a memory controller). The one or more processors 120 may interact with the memory 122 to obtain and execute, for example, computer-readable instructions stored in the memory 122. Additionally or alternatively, computer-readable instructions may be stored on one or more removable media (e.g., a compact disc, a digital versatile disc, removable flash memory, etc.) that may be coupled to the insurance server 102 to provide access to the computer-readable instructions stored thereon. In particular, the computer-readable instructions stored on the memory 122 may include instructions for executing various applications, such as clog determining application 124, and/or artificial intelligence (AI) or machine learning (ML) training application 126. As will be discussed elsewhere herein, in some examples, the AI or ML training application may train the clog determining application 124 (e.g., to determine clogs). For example, as will be described elsewhere herein, the AI or ML training application 126 may route historical data (e.g., from the internal database 118, the external database 180, the dryer 150, the HVAC 185, etc.) into the insurance recommendation ML algorithm to train an AI or ML algorithm used by the clog determining application 124.

Figure 2:
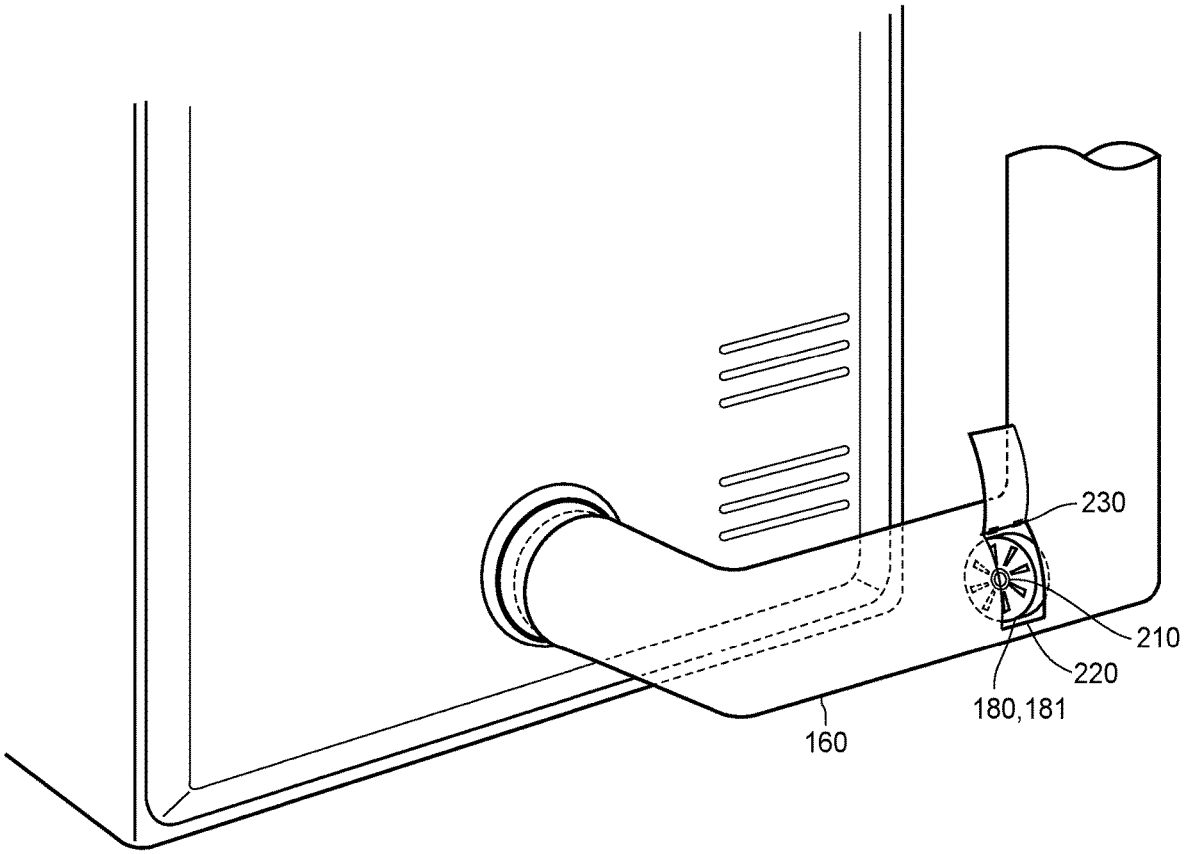
FIG. 2 illustrates an exemplary robot for cleaning a dryer duct and/or heating, ventilation, and air conditioning (HVAC) duct, including a blowing mechanism.

In some embodiments, upon determination of a clog, robot 180 may be activated to remove the clog. In some examples, as illustrated in the example of FIG. 2, the robot 180 comprises a blowing mechanism 210 that is inserted through a window 220 of the dryer duct 160. The blowing mechanism may be any suitable blowing mechanism (e.g., a fan, a mechanism for releasing compressed air, etc.). The robot 180 may be attached to the dryer duct 160 via hinge 230.

Figure 3:
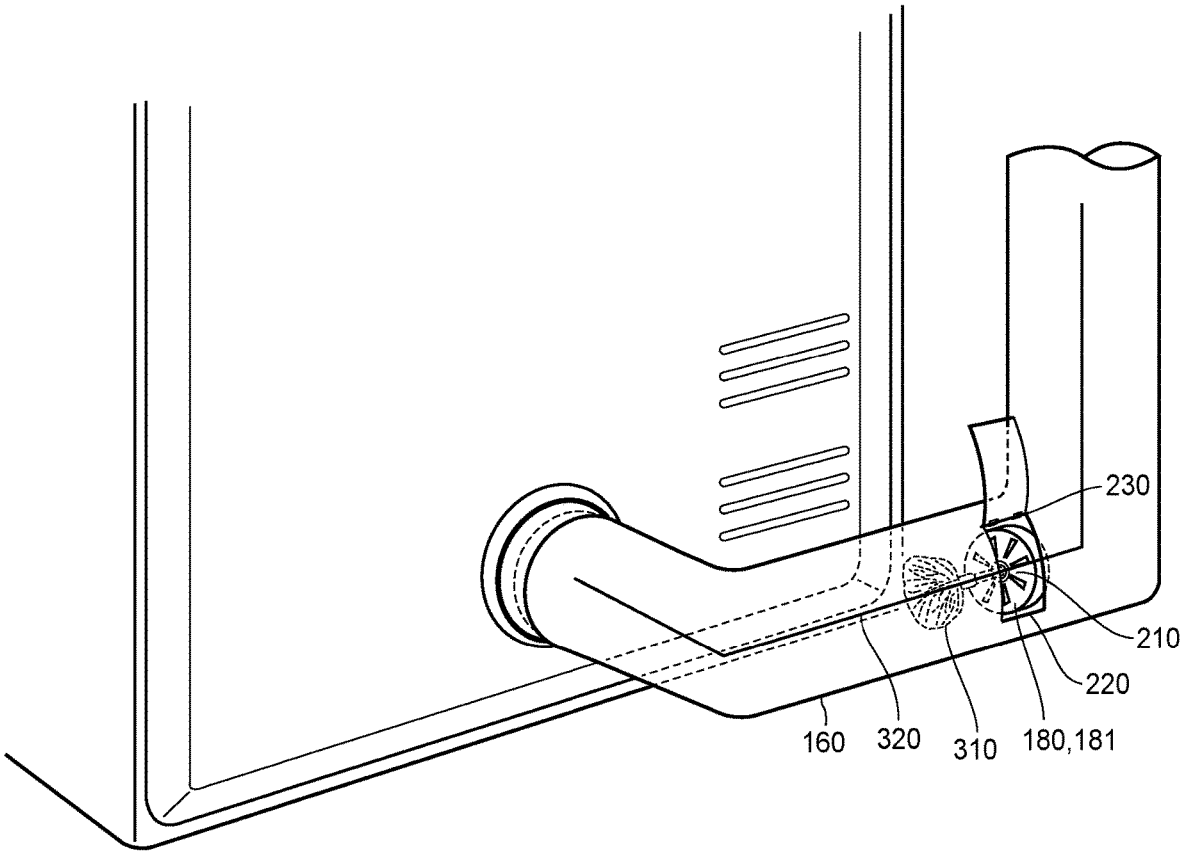
FIG. 3 illustrates an exemplary robot for cleaning a dryer duct and/or HVAC duct, including a cleaning arm and configured to move along a tract.

In other examples, as illustrated in the example of FIG. 3, the robot 180 may move along a track 320 of the dryer duct 160 after entering the dryer duct 160 via window 220. The robot may comprise a cleaning arm 310 (e.g., comprising a brush, etc.) and/or a blowing mechanism (not shown in the example of FIG. 3) to clean clogs.

In some variations, a robot 181 may be used to clean the heating, ventilation, and air conditioning (HVAC) duct 187. The robot 181 may have any of the characteristics of the robot 180 (e.g., a blowing mechanism, a cleaning arm, etc.). In this regard, it should be understood that, in some variations, the robot 181 is as illustrated in FIG. 2 and/or FIG. 3, but the dryer duct 160 is replace by the HVAC duct 187.

The HVAC 185 may be a smart HVAC system. For example, the HVAC 185 may include one or more processors 186 such as one or more microprocessors, controllers, and/or any other suitable type of processor. The HVAC 185 may further include a memory (e.g., volatile memory, non-volatile memory) accessible by the one or more processors 186, (e.g., via a memory controller). The one or more processors 186 may interact with the memory to obtain and execute, for example, computer-readable instructions stored in the memory. Additionally or alternatively, computer-readable instructions may be stored on one or more removable media (e.g., a compact disc, a digital versatile disc, removable flash memory, etc.) that may be coupled to the HVAC 185 to provide access to the computer-readable instructions stored thereon. In particular, the computer-readable instructions stored on the memory may include instructions for executing various applications, such as an HVAC clog determining application.

The airflow sensor 182 may be any type of airflow sensor (e.g., a volume airflow sensor, a mass airflow sensor, etc.). In addition, the airflow sensor 182 may be positioned at any point within the HVAC duct 187. In some examples, one airflow sensor 182 may be placed at the exhaust of the HVAC 185 (e.g., where the HVAC 185 connects to the HVAC duct 187, such as an HVAC attachment area), and another airflow sensor 182 may be placed at the opposite end of the HVAC duct 187 (e.g., where the HVAC duct 187 enters/exits the building); advantageously, such placement improves accuracy of the airflow measurement.

The pressure sensor 183 may be any type of pressure sensor, such as an aneroid barometer pressure sensor, a manometer pressure sensor, a bourdon tube pressure sensor, a vacuum (Pirani) pressure sensor, a sealed pressure sensor, a piezoelectric pressure sensor, a strain gauge pressure sensor, etc. The pressure sensors 183 may be positioned at any point inside the HVAC duct 187. In some embodiments, a pressure sensor 183 is positioned at the exhaust of the HVAC 185 (e.g., where the HVAC 185 connects to the HVAC duct 187, such as an HVAC attachment area).

The temperature sensor 184 may be any type of temperature sensor, such as a thermometer, a thermistor, a thermocouple, resistance temperature detector (RTD), a thermopile, an infrared (IR) temperature sensor, etc. The temperature sensors 184 may be positioned at any point inside and/or outside of the HVAC duct 187. In some embodiments, a temperature sensor 184 is positioned at the exhaust of the HVAC 185 (e.g., where the HVAC 185 connects to the HVAC duct 187, such as an HVAC attachment area).

The accelerometer 185 may be any type of accelerometer (e.g., an alternating current (AC)-response accelerometer, a direct current (DC)-response accelerometer, etc.). The accelerometer 185 may be positioned anywhere on the inside and/or the outside of the HVAC duct 187. In some implementations, the accelerometer 185 may be used to determine an HVAC duct displacement level (e.g., an amount that the HVAC duct 187 has expanded, such as an increase in a diameter, length, and/or width of the HVAC duct 187).

Any of the any of the airflow sensor 182, pressure sensor 183, temperature sensor 184, and/or accelerometer 185 may be connected to the HVAC 185 and/or smart home hub 155 through the network 104 (e.g., the internet, etc.). Additionally or alternatively, the airflow sensor 182, pressure sensor 183, temperature sensor 184, and/or accelerometer 185 may be connected to the HVAC 185 and/or smart home hub 155 directly, such as via a wired (e.g., ethernet, etc.), and/or wireless (e.g., via Bluetooth, etc.).

Any of the components of the example system 100 may be controlled by a user 190 of a smartphone 195 (e.g., comprising one or more processors, etc.).

In addition, further regarding the example system 100, the illustrated exemplary components may be configured to communicate, e.g., via a network 104 (which may be a wired or wireless network, such as the internet), with any other component. Furthermore, although the example system 100 illustrates only one of each of the components, any number of the example components are contemplated (e.g., any number of dryers, dryer ducts, smart home hubs, HVACs, HVAC ducts, users, smartphones, internal databases, external databases, etc.).

Exemplary AI and/or ML Training

In some embodiments, AI and/or ML algorithms may be used to determine a dryer duct clog (e.g., via a dryer duct clog determining AI and/or ML algorithm), and/or determine an HVAC duct clog (e.g., via an HVAC clog determining AI and/or ML algorithm). It should be appreciated that although the following discussion may refer singularly to AI or ML algorithms, it applies equally to AI and ML algorithms. It should further be appreciated that although the following discussion refers to the AI and/or ML training application 126 (and/or the one or more processors 185) as training the AI and/or ML algorithms, any of the one or more processors 151. the one or more processors 156, and/or the one or more processors 186 may train any of the AI and/or ML algorithms discussed herein.

In some embodiments, the AI and/or ML training application 126 may train the dryer duct clog determining ML algorithm to determine clogs in the dryer duct 160. For example, the AI and/or ML training application 126 may receive the historical information to train the dryer duct clog determining machine learning algorithm. In some examples, the historical information comprises: (a) inputs to the machine learning model (e.g., also referred to as independent variables, or explanatory variables), and/or (b) outputs of the machine learning model (e.g., also referred to as dependent variables, or response variables). The historical information may be received from any suitable source, such as the external database 180, the internal database 118, the airflow sensor 170, the pressure sensor 172, the temperature sensor 174, the accelerometer 176, the dryer 150, the HVAC 185, etc.).

In some such examples, the dependent variables are the clogs that the dryer duct clog determining ML algorithm is trained to determine (e.g., the dependent variable of the dryer duct clog determining ML algorithm is the dryer duct clog), and the independent variables are used to determine the dependent variables (e.g., an independent variable of the dryer duct clog determining ML algorithm may be an airflow of the dryer duct 160, etc.). Put another way, the independent variables may have an impact on the dependent variables, and the ML algorithms may be trained to find this impact.

More specifically, for the historical information used to train the dryer duct clog determining machine learning algorithm, examples of the independent variables may include: (i) historical airflow levels; (ii) historical operation status signals of dryers; (iii) historical pressure levels; (iv) historical temperature levels; and/or (v) historical dryer duct displacement levels. An example of the dependent variable in the historical information are dryer duct clogs.

Any of the historical information may be of dryer ducts generally (e.g., not just the dryer duct 160) and/or of the dryer duct 160 specifically (e.g., the specific dryer duct 160 for which the clog determining training application 124 will be run). Advantageously, training on data of the dryer duct 160 specifically allows for a more accurate determination of dryer duct clogs (e.g., because the ML algorithm "learns" the specific characteristics of dryer duct 160). To this end, in some embodiments, the dryer 150 may be run a predetermined number of times (e.g., 5 times, 10 times, 100 times, etc.) to gather the historical data. In some such embodiments, the user 190 indicates via the smart phone 195 if there was a clog when the dryer was run (e.g., as the dependent variable of the historical data). It should be appreciated that in some such embodiments, the historical data thus comes from the airflow sensor 170, pressure sensor 172, temperature sensor 174, accelerometer 176, one or more processors 151, etc. In some such embodiments, the one or more processors 151 perform the training.

In some embodiments, the one or more processors 151 may train the HVAC duct clog determining ML algorithm to determine clogs in the HVAC duct 187. For example, the one or more processors 151 may receive the historical information to train the HVAC duct clog determining machine learning algorithm. In some examples, the historical information comprises: (a) inputs to the machine learning model (e.g., also referred to as independent variables or explanatory variables), and/or (b) outputs of the machine learning model (e.g., also referred to as dependent variables or response variables). The historical information may be received from any suitable source, such as the external database 180, the internal database 118, the airflow sensor 182, the pressure sensor 183, the temperature sensor 184, the accelerometer 185, the HVAC 185, etc.

In some such examples, the dependent variables are the clogs that the HVAC duct clog determining ML algorithm is trained to determine (e.g., the dependent variable of the HVAC duct clog determining ML algorithm is the HVAC duct clog), and the independent variables are used to determine the dependent variables (e.g., an independent variable of the HVAC duct clog determining ML algorithm may be an airflow of the HVAC duct 187, etc.). Put another way, the independent variables may have an impact on the dependent variables, and the ML algorithms may be trained to find this impact.

More specifically, for the historical information used to train the HVAC duct clog determining machine learning algorithm, examples of the independent variables may include: (i) historical airflow levels; (ii) historical operation status signals of HVAC systems; (iii) historical pressure levels; (iv) historical temperature levels; and/or (v) historical HVAC duct displacement levels. An example of the dependent variable in the historical information are HVAC duct clogs.

Any of the historical information may be of HVAC ducts generally (e.g., not just the HVAC duct 187), and/or of the HVAC duct 187 specifically (e.g., the specific HVAC duct 187 on which the HVAC duct clog determining AI algorithm will be used). Advantageously, training on data of the HVAC duct 187 specifically allows for a more accurate determination of HVAC duct clogs (e.g., because the ML algorithm "learns" the specific characteristics of HVAC duct 187). To this end, in some embodiments, the HVAC 185 is run a predetermined number of times (e.g., 5 times, 10 times, 100 times, etc.) or for a predetermined time period (e.g., 10 minutes, an hour, a day, etc.) to gather the historical data. In some such embodiments, the user 190 indicates via the smart phone 195 if there was a clog when the HVAC 185 was run (e.g., as the dependent variable of the historical data). It should be appreciated that in some such embodiments, the historical data thus comes from the airflow sensor 182, pressure sensor 183, temperature sensor 184, accelerometer 185, one or more processors 186, etc. In some such embodiments, the one or more processors 186 perform the training.

Exemplary Dryer Duct Safety Methods

Figure 4:
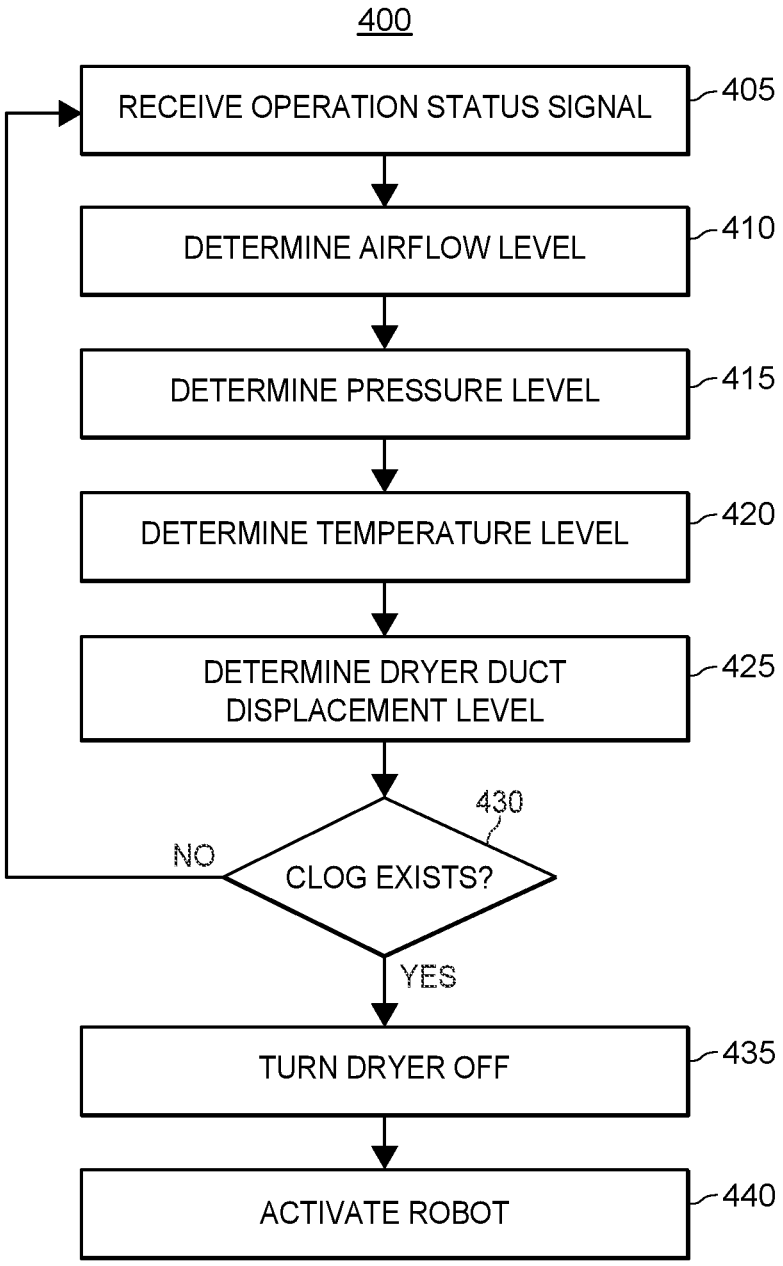
FIG. 4 shows an exemplary computer-implemented method or implementation for dryer duct safety.

FIG. 4 shows an exemplary computer-implemented method or implementation 400 for dryer duct safety. Although the following discussion refers to the exemplary method or implementation 400 as being performed by the clog determining application 124, it should be understood that any or all of the blocks may be alternatively or additionally performed by any other suitable component as well (e.g., another component of the one or more processors 151, the one or more processors 156, the one or more processors 120, etc.).

The exemplary computer-implemented method or implementation 400 may begin at block 405 when the clog determining application 124 receives an operation status signal (e.g., from the dryer 150). The operation status signal may indicate that the dryer 150 is running, that the dryer 150 has been activated, etc. In some embodiments, upon activation of the dryer 150 (e.g., via the user 190 starting the dryer 150 via a keypad of the dryer 150, via the smartphone 195, etc.), the operation status signal is received by the clog determining application 124.

At block 410, the clog determining application 124 may determine an airflow level of the dryer duct 160. For example, the clog determining application 124 may receive an airflow signal from the airflow sensor 170, and then determine the airflow level from the received airflow signal. The airflow may be measured according to any suitable standard (e.g., cubic feet per minute, etc.).

At block 415, the clog determining application 124 may determine a pressure level of the dryer duct 160. For example, the clog determining application 124 may receive a pressure signal from the pressure sensor 172, and then determine the pressure level from the received pressure signal. The pressure may be measured according to any suitable standard (e.g., in units of force per unit of surface area, etc.).

At block 420, the clog determining application 124 may determine a temperature level of the dryer duct 160. For example, the clog determining application 124 may receive a temperature signal from the temperature sensor 174, and then determine the temperature level from the received temperature signal.

At block 425, the clog determining application 124 may determine a dryer duct displacement level of the dryer duct 160. For example, the clog determining application 124 may receive an accelerometer signal from the accelerometer 176, and then determine the dryer duct displacement level from the received accelerometer signal. The dryer duct displacement may be measured according to any suitable standard (e.g., a length of the displacement in inches, centimeters, etc., an expansion that is a percentage of a diameter of the dryer duct 160, etc.).

At decision block 430, the clog determining application 124 may determine if a clog exists in the dryer duct 160. The determination may be made by any suitable technique. In some examples, the determination is made via an AI and/or ML algorithm, as described above. Additionally or alternatively, the determination may be made based upon predetermined threshold(s). For example, the clog determining application 124 may determine that a clog exists if (i) the operation status signal indicates that the dryer 150 is on, and (ii): (a) the airflow level is below a predetermined airflow level, (b) the pressure level is above a predetermined pressure level, (c) the temperature level is above a predetermined temperature level, and/or (d) the dryer duct displacement level is above a predetermined dryer duct displacement level.

In some embodiments, the predetermined level(s) may be based upon measurements of the dryer duct 160. For example, the predetermined airflow level may be based upon: a pressure level of the dryer duct 160; a temperature level of the dryer duct 160; and/or a displacement level of the dryer duct 160. For instance, if the temperature level is higher, the clog determining application 124 may lower the predetermined airflow level because a clog is more likely when the temperature is higher. In another example, the predetermined pressure level may be based upon: an airflow level of the dryer duct 160; a temperature level of the dryer duct 160; and/or a displacement level of the dryer duct 160. In another example, the predetermined temperature level may be based upon: an airflow level of the dryer duct 160; a pressure level of the dryer duct 160; and/or a displacement level of the dryer duct 160. In another example, the predetermined displacement level may be based upon: an airflow level of the dryer duct 160; a pressure level of the dryer duct 160; and/or a temperature level of the dryer duct 160.

Additionally or alternatively, the determination may be made via a lookup table. For example, a lookup table with inputs of an operation status signal, an airflow level, a pressure level, a temperature level, and/or a dryer duct displacement level may be used to determine if there is a clog.

If it is determined that no clog exists, the exemplary method may return to block 405. In some embodiments, the determination at block 430 may be made periodically (e.g., every second, every minute, every 10 minutes, etc.). In this regard, in some embodiments, any or all of blocks 405-430 may be performed periodically. For example, at predetermined time intervals, the clog determining application 124 may: receive an operation status signal; determine an airflow level; determine a pressure level; determine a temperature level; determine a dryer duct displacement level; and/or determine if a clog exists.

If it is determined that a clog exists, the dryer 150 may be shut off at block 435 (e.g., the dryer 150 is shut off in response to the determination that a clog exists). Additionally or alternatively, an alert may be displayed on a screen of the dryer 150, the smart home hub 155, and/or the smartphone 195 that a clog has been detected. The alert may additionally or alternatively be an audio and/or haptic alert (e.g., sent though the dryer 150, the smart home hub 155, and/or the smartphone 195).

At block 440, the robot 180 may be activated to clean the dryer duct 160. For example, the window 220 of the dryer duct 160 may be opened, and the blowing mechanism 210 may be inserted into the dryer duct 160 to blow air into the dryer duct 160 to remove the clog (e.g., such as in the example of FIG. 2). In another example, the robot 180 may move along a tract 320 and may remove the clog via a cleaning arm 310 and/or blowing mechanism (e.g., such as in the example of FIG. 3).

In some examples, the robot 180 may be deployed to a particular section of the dryer duct 160. For example, the system may know what section of the dryer duct 160 a clog has occurred in (e.g., because of the placement of multiple airflow sensors 170, pressure sensors 172, temperature sensors 174, accelerometers 176, etc.); and the robot 180 may be deployed only in the particular section of the dryer duct 160 where the clog is detected to have occurred.

It should be understood that not all blocks and/or events of the exemplary signal diagrams and/or flowcharts are required to be performed. Moreover, the exemplary signal diagrams and/or flowcharts are not mutually exclusive (e.g., blocks/events from each example signal diagram and/or flowchart may be performed in any other signal diagram and/or flowchart). The exemplary signal diagrams and/or flowcharts may include additional, less, or alternate functionality, including that discussed elsewhere herein.

Exemplary Embodiments—Dryer Duct Safety

In one aspect, a computer system for dryer safety may be provided. The computer system may include one or more local or remote processors, sensors, transceivers, servers, memory units, augmented reality glasses or headsets, extended or virtual reality headsets, smart glasses or watches, wearables, and/or other electronic or electrical components. In one aspect, the computer system may include one or more processors configured to: (1) receive, from a dryer connected to the dryer duct or from another component monitoring dryer operation, an operation status signal of the dryer; (2) determine an airflow level based upon an airflow signal received from the airflow sensor; and/or (3) determine that a clog exists in the dryer duct based upon: (i) the airflow level; and (ii) the operation status signal. The computer system may include additional, less, or alternate functionality, including that discussed elsewhere herein.

In some embodiments, the system may further include a pressure sensor. The one or more processors may be further configured to: determine a pressure level based upon a pressure signal received from the pressure sensor; and/or determine that the clog exists further based upon the pressure level.

In some embodiments, the airflow sensor is attached to the dryer duct at an air entry area to a house; and/or the pressure sensor is attached to the dryer duct at a dryer attachment area.

In some embodiments, the airflow sensor and the pressure sensor are both disposed on an interior portion of the dryer duct.

In some embodiments, the system may further include a temperature sensor. The one or more processors may be further configured to: determine a temperature level based upon a temperature signal received from the temperature sensor; and/or determine that the clog exists further based upon the temperature level.

In some embodiments, the temperature sensor is attached to an exterior of the dryer duct.

In some embodiments, the system may further include an accelerometer attached to the dryer duct. The one or more processors may be further configured to: determine a dryer duct displacement level of the dryer duct based upon an accelerometer signal received from the accelerometer; and/or determine that the clog exists further based upon the dryer duct displacement level.

In some embodiments, the one or more processors are further configured to stop operation of the dryer upon a determination that the clog exists in the dryer duct.

In some embodiments, the one or more processors are further configured to: determine that the clog exists in the dryer duct by inputting (i) the airflow level; and/or (ii) the operation status signal into a trained dryer duct clog determining artificial intelligence (AI) algorithm.

In some embodiments, the one or more processors are further configured to: train the dryer duct clog determining AI algorithm by inputting (i) historical airflow levels; and/or (ii) historical operation status signals into the dryer duct clog determining AI algorithm.

In some embodiments, the system may further include: a pressure sensor configured to output a pressure signal; a temperature sensor configured to output a temperature signal; and/or an accelerometer configured to output an accelerometer signal; and/or wherein the one or more processors are further configured to: determine a pressure level based upon the pressure signal received from the pressure sensor; determine a temperature level based upon the temperature signal received from the temperature sensor; determine a dryer duct displacement level of the dryer duct based upon the accelerometer signal received from the accelerometer; and/or determine that the clog exists in the dryer duct by inputting (i) the airflow level; (ii) the operation status signal; (iii) the pressure level; (iv) the temperature level; and/or (v) the dryer duct displacement level into a trained dryer duct clog determining artificial intelligence (AI) algorithm.

In some embodiments, the one or more processors are further configured to: train the dryer duct clog determining AI algorithm by inputting (i) historical airflow levels; (ii) historical operation status signals of dryers; (iii) historical pressure levels; (iv) historical temperature levels; and/or (v) historical dryer duct displacement levels into the dryer duct clog determining AI algorithm.

In some embodiments, the one or more processors are further configured to: upon determination that the clog exists, activate a robot to clean the dryer duct.

In some embodiments, the robot is configured to: insert a blowing mechanism into an interior portion of the dryer duct; and/or activate the blowing mechanism upon insertion into the interior portion of the dryer duct.

In some embodiments, the robot: comprises a cleaning arm, and/or a blowing mechanism; and/or is configured to move along an interior portion of the dryer duct.

In another aspect, a computer-implemented method for dryer safety may be provided. The method may be implemented via one or more local or remote processors, sensors, transceivers, servers, memory units, augmented reality glasses or headsets, extended or virtual reality headsets, smart glasses or watches, wearables, and/or other electronic or electrical components. In one aspect, the method may include: (1) receiving, via one or more processors, from a dryer connected to the dryer duct or from another component monitoring dryer operation, an operation status signal of the dryer; (2) determining, via the one or more processors, an airflow level based upon an airflow signal received from the airflow sensor; and/or (3) determining, via the one or more processors, that a clog exists in the dryer duct based upon: (i) the airflow level; and (ii) the operation status signal. The method may include additional, fewer, or alternate actions, including those discussed elsewhere herein.

For instance, in some embodiments, the method further may include: determining, via the one or more processors, a pressure level based upon a pressure signal received from a pressure sensor; and/or determining, via the one or more processors, that the clog exists further based upon the pressure level.

In some embodiments, the method further includes in response to determining that the clog exists, activating a robot to clean the dryer duct.

In yet another aspect, a computer device for dryer safety may be provided. The computer device may include one or more local or remote processors, sensors, transceivers, servers, memory units, augmented reality glasses or headsets, extended or virtual reality headsets, smart glasses or watches, wearables, and/or other electronic or electrical components. In one aspect, the computer device may include: one or more processors; and/or one or more memories coupled to the one or more processors. The one or more memories including computer executable instructions stored therein that, when executed by the one or more processors, may cause the one or more processors to: (1) receive, from a dryer connected to the dryer duct or from another component monitoring dryer operation, an operation status signal of the dryer; (2) determine an airflow level based upon an airflow signal received from the airflow sensor; and/or (3) determine that a clog exists in the dryer duct based upon: (i) the airflow level; and (ii) the operation status signal. The computer device may include additional, less, or alternate functionality, including that discussed elsewhere herein.

For instance, in some embodiments, the one or more memories having stored thereon computer executable instructions that, when executed by the one or more processors, cause the computer device to: upon determination that the clog exists, activate a robot to clean the dryer duct.

Exemplary HVAC Safety Methods

Figure 5:
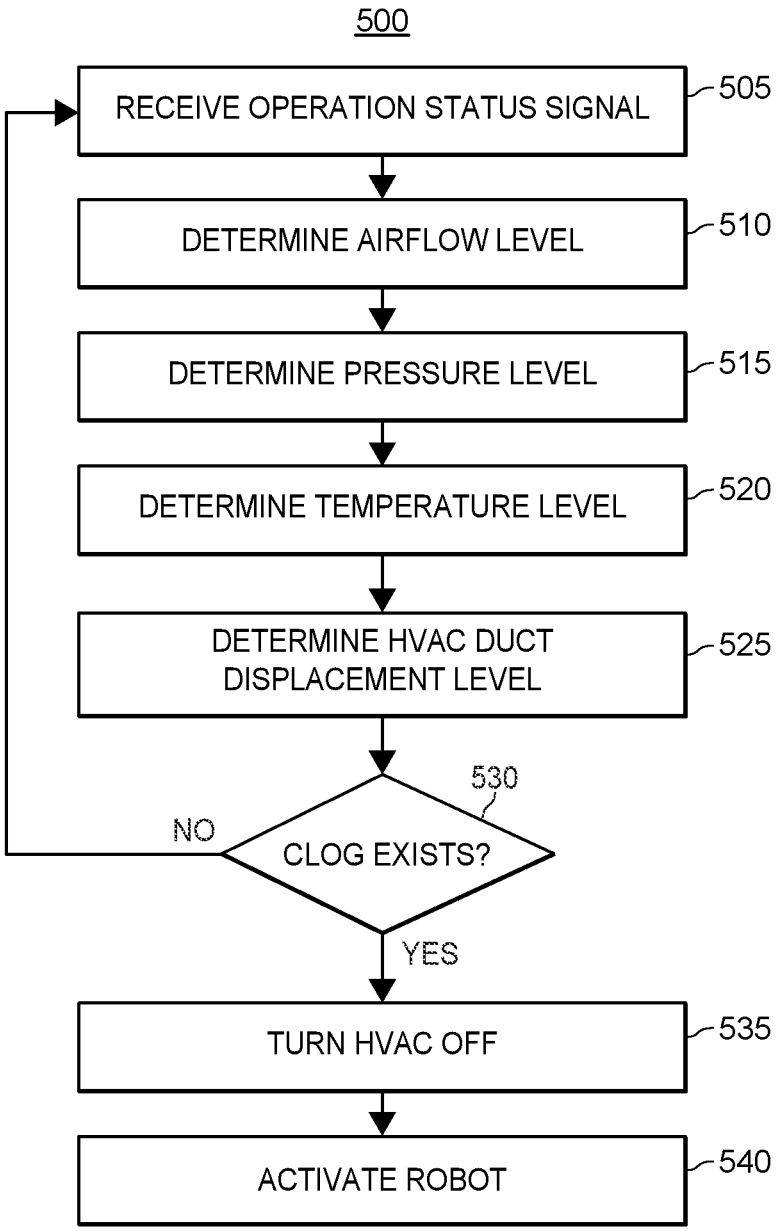
FIG. 5 shows an exemplary computer-implemented method or implementation for HVAC duct safety.

FIG. 5 shows an exemplary computer-implemented method or implementation 500 for HVAC safety and/or cleaning. Although the following discussion refers to the exemplary method or implementation 500 as being performed by the one or more processors 186, it should be understood that any or all of the blocks may be alternatively or additionally performed by any other suitable component as well (e.g., the one or more processors 156, the one or more processors 120, etc.).

The exemplary computer-implemented method or implementation 500 may begin at block 505 when the one or more processors 186 receive an operation status signal (e.g., from the HVAC 185). The operation status signal may indicate if the HVAC 185 is running, or indicate that the HVAC 185 has been activated, etc. In some embodiments, upon activation of the HVAC 185 (e.g., via the user 190 starting the HVAC 185 via a keypad of the HVAC 185, or via the smartphone 195, etc.), the operation status signal is received by the one or more processors 186.

At block 510, the one or more processors 186 may determine an airflow level of the HVAC duct 187. For example, the one or more processors 186 may receive an airflow signal from the airflow sensor 182, and then determine the airflow level from the received airflow signal. The airflow may be measured according to any suitable standard (e.g., cubic feet per minute, etc.).

At block 515, the one or more processors 186 may determine a pressure level of the HVAC duct 187. For example, the one or more processors 186 may receive a pressure signal from the pressure sensor 183, and then determine the pressure level from the received pressure signal. The pressure may be measured according to any suitable standard (e.g., in units of force per unit of surface area, etc.).

At block 520, the one or more processors 186 may determine a temperature level of the HVAC duct 187. For example, the one or more processors 186 may receive a temperature signal from the temperature sensor 184, and then determine the temperature level from the received temperature signal.

At block 525, the one or more processors 186 may determine an HVAC duct displacement level of the HVAC duct 187. For example, the one or more processors 186 may receive an accelerometer signal from the accelerometer 185, and then determine the HVAC duct displacement level from the received accelerometer signal. The HVAC duct displacement may be measured according to any suitable standard (e.g., a length of the displacement in inches, centimeters, etc., an expansion that is a percentage of a diameter of the HVAC duct 187, etc.).

At decision block 530, the one or more processors 186 may determine if a clog exists in the HVAC duct 187. The determination may be made by any suitable technique. In some examples, the determination is made via an AI and/or ML algorithm, as described above. Additionally or alternatively, the determination may be made based upon predetermined threshold(s). For example, the one or more processors 186 may determine that a clog exists if (i) the operation status signal indicates that the HVAC 185 is on, and (ii): (a) the airflow level is below a predetermined airflow level, (b) the pressure level is above a predetermined pressure level, (c) the temperature level is above a predetermined temperature level, and/or (d) the HVAC duct displacement level is above a predetermined HVAC duct displacement level.

In some embodiments, the predetermined level(s) may be based upon measurements of the HVAC duct 187. For example, the predetermined airflow level may be based upon: a pressure level of the HVAC duct 187; a temperature level of the HVAC duct 187; and/or a displacement level of the HVAC duct 187. For instance, if the temperature level is higher, the one or more processors 186 may lower the predetermined airflow level because a clog is more likely when the temperature is higher. In another example, the predetermined pressure level may be based upon: an airflow level of the HVAC duct 187; a temperature level of the HVAC duct 187; and/or a displacement level of the HVAC duct 187. In another example, the predetermined temperature level may be based upon: an airflow level of the HVAC duct 187; a pressure level of the HVAC duct 187; and/or a displacement level of the HVAC duct 187. In another example, the predetermined displacement level may be based upon: an airflow level of the HVAC duct 187; a pressure level of the HVAC duct 187; and/or a temperature level of the HVAC duct 187.

Additionally or alternatively, the determination may be made via a lookup table. For example, a lookup table with inputs of an operation status signal, an airflow level, a pressure level, a temperature level, and/or an HVAC duct displacement level may be used to determine if there is a clog.

If it is determined that no clog exists, the exemplary method may return to block 505. In some embodiments, the determination at block 530 may be made periodically (e.g., every second, every minute, every 10 minutes, etc.). In this regard, in some embodiments, any or all of blocks 505-530 may be performed periodically. For example, at predetermined time intervals, the one or more processors 186 may: receive an operation status signal; determine an airflow level; determine a pressure level; determine a temperature level; determine an HVAC duct displacement level; and/or determine if a clog exists.

If it is determined that a clog exists, the HVAC 185 may be shut off at block 535 (e.g., the HVAC 185 is shut off in response to the determination that a clog exists). Additionally or alternatively, an alert may be displayed on a screen of the HVAC 185, the smart home hub 155, and/or the smartphone 195 that a clog has been detected. The alert may additionally or alternatively be an audio and/or haptic alert (e.g., sent though the dryer 150, the smart home hub 155, and/or the smartphone 195).

At block 540, the robot 181 may be activated to clean the HVAC duct 187. For example, a window of the HVAC duct 187 may be opened, and the blowing mechanism may be inserted into the HVAC duct 187 to blow air into the HVAC duct 187 to remove the clog (e.g., such as in the example of FIG. 2). In another example, the robot 181 may move along a tract of the HVAC duct 187 and may remove the clog via a cleaning arm and/or blowing mechanism (e.g., such as in the example of FIG. 3).

In some examples, the robot 181 may be deployed to a particular section of the HVAC duct 187. For example, the system may know what section of the HVAC duct 187 a clog has occurred in (e.g., because of the placement of multiple airflow sensors 182, pressure sensors 183, temperature sensors 184, accelerometers 185, etc.), and the robot 181 may be deployed only in the particular section of the HVAC duct 187 where the clog is detected to have occurred.

It should be understood that not all blocks and/or events of the exemplary signal diagrams and/or flowcharts are required to be performed. Moreover, the exemplary signal diagrams and/or flowcharts are not mutually exclusive (e.g., blocks/events from each example signal diagram and/or flowchart may be performed in any other signal diagram and/or flowchart). The exemplary signal diagrams and/or flowcharts may include additional, less, or alternate functionality, including that discussed elsewhere herein.

Exemplary Embodiments—HVAC Safety

In one aspect, a computer system for HVAC safety may be provided. The computer system may include one or more local or remote processors, sensors, transceivers, servers, memory units, augmented reality glasses or headsets, extended or virtual reality headsets, smart glasses or watches, wearables, and/or other electronic or electrical components. In one aspect, the computer system may include one or more processors configured to: (1) receive, from an HVAC connected to the HVAC duct or from another component monitoring HVAC operation, an operation status signal of the HVAC; (2) determine an airflow level based upon an airflow signal received from the airflow sensor; and/or (3) determine that a clog exists in the HVAC duct based upon: (i) the airflow level; and (ii) the operation status signal. The computer system may include additional, less, or alternate functionality, including that discussed elsewhere herein.

In some embodiments, the system may further include a pressure sensor. The one or more processors may be further configured to: determine a pressure level based upon a pressure signal received from the pressure sensor; and/or determine that the clog exists further based upon the pressure level.

In some embodiments, the airflow sensor is attached to the HVAC duct at an air entry area to a house; and/or the pressure sensor is attached to the HVAC duct at an HVAC attachment area.

In some embodiments, the airflow sensor and the pressure sensor are both disposed on an interior portion of the HVAC duct.

In some embodiments, the system may further include a temperature sensor. The one or more processors may be further configured to: determine a temperature level based upon a temperature signal received from the temperature sensor; and/or determine that the clog exists further based upon the temperature level.

In some embodiments, the temperature sensor is attached to an exterior of the HVAC duct.

In some embodiments, the system may further include an accelerometer attached to the HVAC duct. The one or more processors may be further configured to: determine an HVAC duct displacement level of the HVAC duct based upon an accelerometer signal received from the accelerometer; and/or determine that the clog exists further based upon the HVAC duct displacement level.

In some embodiments, the one or more processors are further configured to turn the HVAC off upon a determination that the clog exists in the HVAC duct.

In some embodiments, the one or more processors are further configured to: determine that the clog exists in the HVAC duct by inputting (i) the airflow level; and/or (ii) the operation status signal into a trained HVAC duct clog determining artificial intelligence (AI) algorithm.

In some embodiments, the one or more processors are further configured to: train the HVAC duct clog determining AI algorithm by inputting (i) historical airflow levels; and/or (ii) historical operation status signals into the HVAC duct clog determining AI algorithm.

In some embodiments, the system may further include: a pressure sensor configured to output a pressure signal; a temperature sensor configured to output a temperature signal; and/or an accelerometer configured to output an accelerometer signal; and/or wherein the one or more processors are further configured to: determine a pressure level based upon the pressure signal received from the pressure sensor; determine a temperature level based upon the temperature signal received from the temperature sensor; determine an HVAC duct displacement level of the HVAC duct based upon the accelerometer signal received from the accelerometer; and/or determine that the clog exists in the HVAC duct by inputting (i) the airflow level; (ii) the operation status signal; (iii) the pressure level; (iv) the temperature level; and/or (v) the HVAC duct displacement level into a trained HVAC duct clog determining artificial intelligence (AI) algorithm.

In some embodiments, the one or more processors are further configured to: train the HVAC duct clog determining AI algorithm by inputting (i) historical airflow levels; (ii) historical operation status signals of HVACs; (iii) historical pressure levels; (iv) historical temperature levels; and/or (v) historical HVAC duct displacement levels into the HVAC duct clog determining AI algorithm.

In some embodiments, the one or more processors are further configured to: upon determination that the clog exists, activate a robot to clean the HVAC duct.

In some embodiments, the robot is configured to: insert a blowing mechanism into an interior portion of the HVAC duct; and/or activate the blowing mechanism upon insertion into the interior portion of the HVAC duct.

In some embodiments, the robot: comprises a cleaning arm, and/or a blowing mechanism; and/or is configured to move along an interior portion of the HVAC duct.

In another aspect, a computer-implemented method for HVAC safety may be provided. The method may be implemented via one or more local or remote processors, sensors, transceivers, servers, memory units, augmented reality glasses or headsets, extended or virtual reality headsets, smart glasses or watches, wearables, and/or other electronic or electrical components. In one aspect, the method may include: (1) receiving, via one or more processors, from an HVAC connected to the HVAC duct or from another component monitoring HVAC operation, an operation status signal of the HVAC; (2) determining, via the one or more processors, an airflow level based upon an airflow signal received from the airflow sensor; and/or (3) determining, via the one or more processors, that a clog exists in the HVAC duct based upon: (i) the airflow level; and (ii) the operation status signal. The method may include additional, fewer, or alternate actions, including those discussed elsewhere herein.

In some embodiments, the method further includes: determining, via the one or more processors, a pressure level based upon a pressure signal received from a pressure sensor; and/or determining, via the one or more processors, that the clog exists further based upon the pressure level.

In some embodiments, the method further includes in response to determining that the clog exists, activating a robot to clean the HVAC duct.

In yet another aspect, a computer device for HVAC safety may be provided. The computer device may include one or more local or remote processors, sensors, transceivers, servers, memory units, augmented reality glasses or headsets, extended or virtual reality headsets, smart glasses or watches, wearables, and/or other electronic or electrical components. In one aspect, the computer device may include: one or more processors; and/or one or more memories coupled to the one or more processors. The one or more memories including computer executable instructions stored therein that, when executed by the one or more processors, may cause the one or more processors to: (1) receive, from an HVAC connected to the HVAC duct or from another component monitoring HVAC operation, an operation status signal of the HVAC; (2) determine an airflow level based upon an airflow signal received from the airflow sensor; and/or (3) determine that a clog exists in the HVAC duct based upon: (i) the airflow level; and (ii) the operation status signal. The computer device may include additional, less, or alternate functionality, including that discussed elsewhere herein.

In some embodiments, the one or more memories having stored thereon computer executable instructions that, when executed by the one or more processors, cause the computer device to: upon determination that the clog exists, activate a robot to clean the HVAC duct.

Other Matters

Although the text herein sets forth a detailed description of numerous different embodiments, it should be understood that the legal scope of the invention is defined by the words of the claims set forth at the end of this patent. The detailed description is to be construed as exemplary only and does not describe every possible embodiment, as describing every possible embodiment would be impractical, if not impossible. One could implement numerous alternate embodiments, using either current technology or technology developed after the filing date of this patent, which would still fall within the scope of the claims.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based upon any statement made in any section of this patent (other than the language of the claims). To the extent that any term recited in the claims at the end of this disclosure is referred to in this disclosure in a manner consistent with a single meaning, that is done for sake of clarity only so as to not confuse the reader, and it is not intended that such claim term be limited, by implication or otherwise, to that single meaning.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Additionally, certain embodiments are described herein as including logic or a number of routines, subroutines, applications, or instructions. These may constitute either software (code embodied on a non-transitory, tangible machine-readable medium) or hardware. In hardware, the routines, etc., are tangible units capable of performing certain operations and may be configured or arranged in a certain manner. In example embodiments, one or more computer systems (e.g., a standalone, client or server computer system) or one or more hardware modules of a computer system (e.g., a processor or a group of processors) may be configured by software (e.g., an application or application portion) as a hardware module that operates to perform certain operations as described herein.

In various embodiments, a hardware module may be implemented mechanically or electronically. For example, a hardware module may comprise dedicated circuitry or logic that is permanently configured (e.g., as a special-purpose processor, such as a field programmable gate array (FPGA) or an application-specific integrated circuit (ASIC) to perform certain operations). A hardware module may also comprise programmable logic or circuitry (e.g., as encompassed within a general-purpose processor or other programmable processor) that is temporarily configured by software to perform certain operations. It will be appreciated that the decision to implement a hardware module mechanically, in dedicated and permanently configured circuitry, or in temporarily configured circuitry (e.g., configured by software) may be driven by cost and time considerations.

Accordingly, the term "hardware module" should be understood to encompass a tangible entity, be that an entity that is physically constructed, permanently configured (e.g., hardwired), or temporarily configured (e.g., programmed) to operate in a certain manner or to perform certain operations described herein. Considering embodiments in which hardware modules are temporarily configured (e.g., programmed), each of the hardware modules need not be configured or instantiated at any one instance in time. For example, where the hardware modules comprise a general-purpose processor configured using software, the general-purpose processor may be configured as respective different hardware modules at different times. Software may accordingly configure a processor, for example, to constitute a particular hardware module at one instance of time and to constitute a different hardware module at a different instance of time.

Hardware modules can provide information to, and receive information from, other hardware modules. Accordingly, the described hardware modules may be regarded as being communicatively coupled. Where multiple of such hardware modules exist contemporaneously, communications may be achieved through signal transmission (e.g., over appropriate circuits and buses) that connect the hardware modules. In embodiments in which multiple hardware modules are configured or instantiated at different times, communications between such hardware modules may be achieved, for example, through the storage and retrieval of information in memory structures to which the multiple hardware modules have access. For example, one hardware module may perform an operation and store the output of that operation in a memory device to which it is communicatively coupled. A further hardware module may then, at a later time, access the memory device to retrieve and process the stored output. Hardware modules may also initiate communications with input or output devices, and can operate on a resource (e.g., a collection of information).

The various operations of example methods described herein may be performed, at least partially, by one or more processors that are temporarily configured (e.g., by software) or permanently configured to perform the relevant operations. Whether temporarily or permanently configured, such processors may constitute processor-implemented modules that operate to perform one or more operations or functions. The modules referred to herein may, in some example embodiments, comprise processor-implemented modules.

Similarly, the methods or routines described herein may be at least partially processor-implemented. For example, at least some of the operations of a method may be performed by one or more processors or processor-implemented hardware modules. The performance of certain of the operations may be distributed among the one or more processors, not only residing within a single machine, but deployed across a number of machines. In some example embodiments, the processor or processors may be located in a single location (e.g., within a home environment, an office environment or as a server farm), while in other embodiments the processors may be distributed across a number of geographic locations.

Unless specifically stated otherwise, discussions herein using words such as "processing," "computing," "calculating," "determining," "presenting," "displaying," or the like may refer to actions or processes of a machine (e.g., a computer) that manipulates or transforms data represented as physical (e.g., electronic, magnetic, or optical) quantities within one or more memories (e.g., volatile memory, non-volatile memory, or a combination thereof), registers, or other machine components that receive, store, transmit, or display information.

As used herein any reference to "one embodiment" or "an embodiment" means that a particular element, feature, structure, or characteristic described in connection with the embodiment may be included in at least one embodiment. The appearances of the phrase "in one embodiment" in various places in the specification are not necessarily all referring to the same embodiment.

Some embodiments may be described using the expression "coupled" and "connected" along with their derivatives. For example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments are not limited in this context.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the description. This description, and the claims that follow, should be read to include one or at least one and the singular also includes the plural unless it is obvious that it is meant otherwise.

Upon reading this disclosure, those of skill in the art will appreciate still additional alternative structural and functional designs for the approaches described herein. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the method and apparatus disclosed herein without departing from the spirit and scope defined in the appended claims.

The particular features, structures, or characteristics of any specific embodiment may be combined in any suitable manner and in any suitable combination with one or more other embodiments, including the use of selected features without corresponding use of other features. In addition, many modifications may be made to adapt a particular application, situation or material to the essential scope and spirit of the present invention. It is to be understood that other variations and modifications of the embodiments of the present invention described and illustrated herein are possible in light of the teachings herein and are to be considered part of the spirit and scope of the present invention.

While the preferred embodiments of the invention have been described, it should be understood that the invention is not so limited and modifications may be made without departing from the invention. The scope of the invention is defined by the appended claims, and all devices that come within the meaning of the claims, either literally or by equivalence, are intended to be embraced therein.

It is therefore intended that the foregoing detailed description be regarded as illustrative rather than limiting, and that it be understood that it is the following claims, including all equivalents, that are intended to define the spirit and scope of this invention. Furthermore, the patent claims at the end of this patent application are not intended to be construed under 35 U.S.C. § 112 (f) unless traditional means-plus-function language is expressly recited, such as "means for" or "step for" language being explicitly recited in the claim (s). The systems and methods described herein are directed to an improvement to computer functionality, and improve the functioning of conventional computers.

What is claimed:

1. A system for improving dryer safety using an airflow sensor, comprising:

an airflow sensor configured to measure airflow in a dryer duct;

an accelerometer attached to the dryer duct; and one or more processors configured to:

receive an operation status signal of the dryer;

determine an airflow level based upon an airflow signal received from the airflow sensor;

determine a dryer duct displacement level of the dryer duct based upon an accelerometer signal received from the accelerometer; and determine that a clog exists in the dryer duct based upon: (i) the airflow level;

(ii) the dryer duct displacement level; and (iii) the operation status signal.

2. The system of claim 1, further comprising a pressure sensor, and wherein the one or more processors are further configured to:

determine a pressure level based upon a pressure signal received from the pressure sensor; and determine that the clog exists further based upon the pressure level.

3. The system of claim 2, wherein:

the airflow sensor is placed at an exhaust of the dryer; and the pressure sensor is attached to the dryer duct at a dryer attachment area.

4. The system of claim 2, wherein the airflow sensor and the pressure sensor are both disposed on an interior portion of the dryer duct.

5. The system of claim 1, further comprising a temperature sensor, and wherein the one or more processors are further configured to:

determine a temperature level based upon a temperature signal received from the temperature sensor; and determine that the clog exists further based upon the temperature level.

6. The system of claim 5, wherein the temperature sensor is attached to an exterior of the dryer duct.

7. The system of claim 1, wherein the one or more processors are further configured to stop operation of the dryer upon a determination that the clog exists in the dryer duct.

8. The system of claim 1, wherein the one or more processors are further configured to:

determine that the clog exists in the dryer duct by inputting (i) the airflow level; and (ii) the operation status signal into a trained dryer duct clog determining artificial intelligence (AI) algorithm.

9. The system of claim 8, wherein the one or more processors are further configured to:

train the dryer duct clog determining AI algorithm by inputting (i) historical airflow levels; and (ii) historical operation status signals into the dryer duct clog determining AI algorithm.

10. The system of claim 1, further comprising:

a pressure sensor configured to output a pressure signal; and a temperature sensor configured to output a temperature signal; and wherein the one or more processors are further configured to:

determine a pressure level based upon the pressure signal received from the pressure sensor;

determine a temperature level based upon the temperature signal received from the temperature sensor;

determine that the clog exists in the dryer duct by inputting (i) the airflow level; (ii) the operation status signal; (iii) the pressure level; (iv) the temperature level; and (v) the dryer duct displacement level into a trained dryer duct clog determining artificial intelligence (AI) algorithm.

11. The system of claim 10, wherein the one or more processors are further configured to:

train the dryer duct clog determining AI algorithm by inputting (i) historical airflow levels; (ii) historical operation status signals of dryers; (iii) historical pressure levels; (iv) historical temperature levels; and (v) historical dryer duct displacement levels into the dryer duct clog determining AI algorithm.

12. The system of claim 1, wherein the one or more processors are further configured to:

upon determination that the clog exists, activate a robotic component to clean the dryer duct.

13. The system of claim 12, wherein the robotic component is configured to:

insert a blowing mechanism into an interior portion of the dryer duct; and activate the blowing mechanism upon insertion into the interior portion of the dryer duct.

14. The system of claim 12, wherein the robotic component:

comprises a cleaning arm configured to move along an interior portion of the dryer duct.

15. A computer-implemented method for improving dryer safety using an airflow sensor, the method comprising:

receiving, via one or more processors, an operation status signal of the dryer;

determining, via the one or more processors, an airflow level based upon an airflow signal received from the airflow sensor;

determining, via the one or more processors, a dryer duct displacement level of a dryer duct based upon an accelerometer signal received from an accelerometer; and determining, via the one or more processors, that a clog exists in the dryer duct based upon: (i) the airflow level; (ii) the dryer duct displacement level; and (iii) the operation status signal.

16. The computer-implemented method of claim 15, further comprising:

determining, via the one or more processors, a pressure level based upon a pressure signal received from a pressure sensor; and determining, via the one or more processors, that the clog exists further based upon the pressure level.

17. The computer-implemented method of claim 15, further comprising:

in response to determining that the clog exists, activating a robotic component to clean the dryer duct.

18. A computer device for improving dryer safety using an airflow sensor, the computer device comprising:

an airflow sensor configured to measure airflow in a dryer duct;

an accelerometer attached to the dryer duct;

one or more processors; and one or more memories, the one or more memories having stored thereon computer-executable instructions that, when executed by the one or more processors, cause the computer device to:

receive an operation status signal of the dryer;

determine an airflow level based upon an airflow signal received from the airflow sensor;

determine a dryer duct displacement level of the dryer duct based upon an accelerometer signal received from the accelerometer; and determine that a clog exists in the dryer duct based upon: (i) the airflow level; (ii) the dryer duct displacement level; and (iii) the operation status signal.

19. The computer device of claim 18, the one or more memories having stored thereon computer-executable instructions that, when executed by the one or more processors, cause the computer device to:

upon determination that the clog exists, activate a robotic component to clean the dryer duct.

* * * * *